United States Patent [19]

Hampton

[11] Patent Number: 4,665,666

[45] Date of Patent: May 19, 1987

[54] PREFABRICATED ARCHWAY

[76] Inventor: Wade J. Hampton, 4132 E. Gold Dust Ave., Phoenix, Ariz. 85028

[21] Appl. No.: 886,802

[22] Filed: Jul. 18, 1986

Related U.S. Application Data

[63] Continuation-in-part of Ser. No. 677,979, Dec. 4, 1984, Pat. No. 4,601,138.

[51] Int. Cl.[4] ..... E06B 1/32

[52] U.S. Cl. ..... 52/86; 52/211; 52/309.12; D25/60

[58] Field of Search ..... 52/80, 85–89, 52/204, 211, 213, 254, 255, 639, 640, 642, 309.12; 405/124–126, 132, 134; D25/60

[56] References Cited

U.S. PATENT DOCUMENTS

| | | | |
|---|---|---|---|
| 928,265 | 7/1909 | Mahoney et al. | 138/157 |
| 985,539 | 2/1911 | Ottney | 138/162 |
| 1,212,452 | 1/1917 | Caldwell | 405/125 |
| 1,782,147 | 11/1930 | Merryweather | 52/85 |
| 1,804,564 | 5/1931 | McChesney | 52/255 |
| 1,886,320 | 11/1932 | Waite | 52/254 |
| 1,988,739 | 1/1935 | Jones | 52/85 |
| 1,999,426 | 4/1935 | Thayer | 52/250 |
| 2,005,572 | 6/1935 | Vass | 52/85 |
| 2,011,796 | 8/1935 | Christensen | 52/85 |
| 2,064,704 | 12/1936 | Vass | 52/85 |
| 3,005,314 | 10/1961 | Cunningham | 405/134 |
| 3,008,273 | 11/1961 | Widin | 52/85 |
| 3,807,105 | 4/1974 | Rudkin, Jr. et al. | 52/79.1 |
| 4,301,632 | 11/1981 | Wagner | 52/86 |
| 4,400,917 | 8/1983 | Massaro | 52/86 |
| 4,490,953 | 1/1985 | Meola | 52/85 |

FOREIGN PATENT DOCUMENTS

| | | | |
|---|---|---|---|
| 546475 | 9/1957 | Canada | 52/255 |
| 3027870 | 3/1982 | Fed. Rep. of Germany | 52/204 |
| 689613 | 4/1953 | United Kingdom | 52/204 |
| 1590298 | 5/1981 | United Kingdom | 52/85 |

*Primary Examiner*—John E. Murtaga
*Assistant Examiner*—Andrew Joseph Rudy
*Attorney, Agent, or Firm*—Fleit, Jacobson, Cohn & Price

[57] ABSTRACT

A prefabricated unitary body forming an archway is made of a light, durable material. The body includes a corner bead and abuts against the walls around the archway. The archway is nailed in place and drywall compound is applied, tapering from the corner bead of the archway to fill and cover the seam joining the archway within a framed opening of a doorway or window.

13 Claims, 4 Drawing Figures

PREFABRICATED ARCHWAY

This application is a continuation-in-part of application Ser. No. 677,979, which was filed Dec. 4, 1984, now U.S. Pat. No. 4,601,138.

BACKGROUND OF THE INVENTION

The prefabricated archway of the present invention is made of a light, durable material, preferably polyurethane molding foam. This facilitates quick assembly of archways in door frames or along hallways. The cove arch of the present invention is also made of a light, durable material. A cove arch interconnects a ceiling and a side wall or is located at the top of a recessed portion of a wall used for the display of artwork or a statue.

DESCRIPTION OF THE PRIOR ART

Present practice for the construction of an archway includes the laborious task of creating the archway at the job site. Two sheets of plywood are presently cut to the width of a cased opening within which the archway is to be framed. A semicircle is cut from each piece of plywood to form the boundary of the archway. The two pieces of plywood are spaced from one another a required distance to form the arch. In standard doorway openings, this distance is 4½ inches. If ½ inch plywood is used which will be covered on both sides by ½ inch thick drywall, the plywood pieces are spaced 2½ inches from each other. The space between each of the pieces of plywood is then filled with numerous support pieces usually cut from two by fours or two by twos which are secured to both pieces of plywood and extend at their outer face to the periphery of the semicircles.

In a typical arched doorway, the pieces of ½ inch thick plywood are spaced 2½ inches from each other. Sections of drywall are cut which measure 4½ inches long by 1 inch wide which are then secured to the exposed faces of the two by fours or two by twos and overlap onto the semicircles of the plywood to form the curve of the arch. Difficulty is usually experienced in securing the drywall to the two by fours or two by twos to form a continuously smooth curve along the exposed face of the support pieces and semicircles of the plywood forming the archway. Drywall sections of ½ inch width are also applied to the exposed surfaces of the plywood to bring the total width of the archway to 4½ inches.

After the dry wall is secured to the support pieces and exposed face of the plywood, the corner formed between the edges of the drywall and the curves of the drywall secured to the plywood is covered by drywall tape and a metal corner bead is nailed around the edges of the curves. The corner bead is partially cut in a transverse direction at 1 inch intervals to allow for the curving of the corner bead about the edges of the drywal secured to the plywood and sections of drywall on the support pieces. The corner bead, drywall tape and space between adjacent support pieces secured between the plywood is filled in with drywall compound and finished to a smooth surface by sanding. The numerous sections of drywall required to form the archway results in an uneven curve and heavy application of drywall compound is required. The entire process of assembling and finishing the archway at the job site requires many man hours.

In U.S. Pat. No. 3,008,273 to Widin, an arch is formed by an arcuate plasterboard panel having side edges engaging a pair of spaced parallel plasterboard panels. The panels have their edges in contact with the panel which is concavely arcuate to conform to the shape of the panel. A corner bead, curved to conform to the shape of the panel and also to the flat surface of the panels, has a plurality of slits cut therein, in spaced parallel relation to permit the corner bead to be curved. Tubular rivets extend through the corner bead and through the panels to secure the panels to the opposite side edges of the arcuate panel. The arcuate panel is formed by a plurality of spaced parallel transversely extending kerf cuts extending through one side thereof and the plaster with the finished paper being left intact on the opposite side. The panel is then placed over an arcuate form with the curved cuts extending upwardly. In this position, wet plaster is pressed into the curved cuts to completely fill in the curved cuts and provide a plastic surface over the rear face of the panel. Paper tape is then adhered to the plaster to form a smooth finished surface for the panel. The side panels are attached to opposite side edges of the arcuate panel.

In U.S. Pat. No. 2,064,704 to Vass, an arch is formed by assembly of a plurality of parts including first and second U-shaped metal strips having a web and outstanding flanges and the outstanding flanges of the second strip are greater in width than the flanges of the first strip. The webs of each strip are placed in abutting face to face relation with the flanges of each strip extending in the same direction. The distance between the webs is equal to twice the thickness of wallboard or other building material. The two strips form arch channels adjacent each edge of the resulting unit for the purpose of receiving the edges of the wallboard. The arch units are made to meet at their upper ends with another arch unit located below a framing member. The wallboard is required to be pre-cut to the shape of an arch and inserted within the channels formed between the strips of different widths. A perforated metal tape is applied over the joint of the wallboards by means of a joint filler cement.

U.S. Pat. No. 2,011,796 to Christensen, discloses similar wall sections overlapped on each other so that the complete unit with separate corner beads is adjustable as to width.

U.S. Pat. No. 2,005,572 to Vass discloses archways of reticulated metal which is attached to the framework of a building and forms a firm bond for a plaster coating.

SUMMARY OF THE INVENTION

The prefabricated archway of the present invention is sized to fit various framed openings and thereby quickly facilitates the formation of a uniformly curved archway. Two prefabricated half archways may be used in nonstandard sized framed openings for increasing the width of the arch.

Two full prefabricated archways or four half archways are used for forming archways of greater length than a normal framed doorway and may be spaced from each other at constant intervals over a distance and connected by curved sheets of polyurethane. When a large width and length are required, prefabricated half archways may be used spaced across from another half archway in pairs over a distance, in combination with a flexible sheet.

A prefabricated cove arch is formed from a prefabricated half archway which has had its pointed end sections cut away and corner bead cut off or is prefabricated as a unitary body for interconnecting a ceiling and a side wall.

A prefabricated one-quarter archway includes drywall paper along its inner and outer flat surfaces as well as along the arch curve. The one-quarter archway is glued to a second one-quarter archway to form a one-half archway. Two opposed one-half archways formed from four one-quarter archways, define a full semicircular archway. Two one-quarter archways may also be used to form an archway about a window opening.

It is an object of the present invention to provide a prefabricated archway having a body of unitary construction made of a durable, light material.

It is a further object of the present invention to provide a prefabricated cove arch having a body of unitary construction made of a durable, light material.

It is another object of the present invention to form a prefabricated archway with an integral corner bead and recesses defined between its side walls.

It is still another object of the present invention to define recesses located at the ends of the curved section of the archway, shaped complementary to a corner bead which extends from a framed opening which has been covered with drywall, to receive the corner bead in abutting relation with the integral corner bead of the prefabricated archway.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
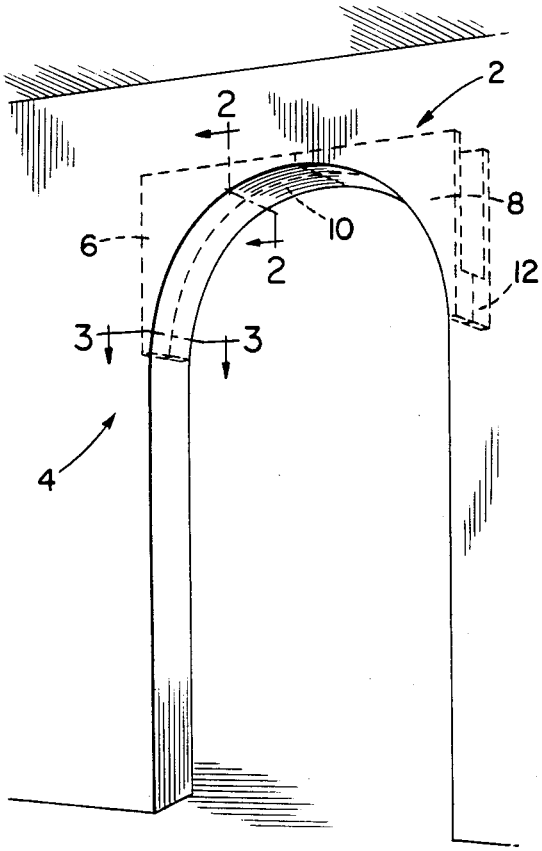
FIG. 1 is a perspective view of a full semicircular archway installed within a framed opening.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

In FIG. 1, prefabricated archway 2 is shown installed within a doorway 4. Four quarter archway sections 6, 8, 10 and 12 are shown in phantom in FIG. 1 as would appear after installation is complete.

The archway sections are formed by injection molding an isocyanate and resin mixture to form nominal 12 pound density polyurethane foam which is allowed to cure and become rigid. A mold defining the outline of the archway 2 is initially lined with three sections of drywall paper, preferably having a thickness in the range of 14–25 thousandths of an inch, preferably 15 thousandths of an inch. The archway is removed from the mold with the drywall paper permanently bonded on its exterior surfaces, preferably along an exterior surface of a side wall, an interior surface of the side wall and along a curved planar surface.

The drywall paper allows for excellent adhesion of drywall taping compound to the archway. The paper also eliminates required surface preparation of the archway such as painting and sanding to provide a good bonding surface for drywall compound on the archway. Further, the drywall paper considerably strengthens the arch by adding a fibrous laminate to its exterior surface which eliminates cracking or breaking. The drywall paper allows for excellent fastening characteristics due to the elimination of "nail pops" which are caused when the head of a nail works its way into its hammered location and punctures through a brittle surface. Also, the drywall paper allows full formation of the arch during the molding process by eliminating air entrapment within the polyurethane foam In addition, the drywall paper eliminates warpage of the archway due to sun and heat exposure.

Each quarter archway section 6, 8, 10, 12 includes curved planar surface section 14, side walls 16 and 25, top wall 18, bottom wall 20, and rear wall 22. Secured to an interior and exterior surface of side wall 16 are drywall paper sections 24 and 26. Drywall paper section 28 is secured to curved planar surface 14.

Each quarter archway is made of a unitary body and includes an open area 30 defining an opening approximately $1\frac{3}{4}$ inches wide, $3\frac{1}{2}$ inches wide between the interior surface of side walls 16 of two quarter archways secured along side wall 25. Side wall 16 located on opposite sides of the open areas 30 are each $\frac{1}{2}$ inch thick, preferably the thickness of a drywall panel. The combined width of two quarter archways is $4\frac{1}{2}$ inches and is designed to fit flush with the exterior surfaces of a standard cased door frame made from two by fours 31 and 32, measuring $3\frac{1}{2}$ inches wide with $\frac{1}{2}$ inch thick drywall panels 34 located on opposite sides of the two by fours 31 and 32.

Curved section 14 forms a constant, continuous curve of 90° between opposed flat end sections 20 and 36 of one-half inch thickness, designed to abut and lie flush with one-half inch thick drywall panels located adjacent to and abutting the bottom wall 20. Wall 20 of the archway rests on top of and forms a seam with the one-half inch thick plasterboard which covers vertical studs 31 framing the doorway or opening into which the archway is positioned. If $\frac{5}{8}$ inch thick drywall is to be used, the side wall 16 would be formed to also measure $\frac{5}{8}$ inch thick as would the bottom wall 20. This assures a continuous, smooth surface from the planar face of the curved section 14 to the abutting drywall sections adjacent to bottom wall 20.

A longitudinal edge of the curved section 14 include an integral corner bead 38 defined between the drywall paper sections 24 and 28 located on the exterior surface of side wall 16 and on curved section 14. The corner bead 38 extends approximately one-sixteenth to one-eighth of an inch from the curved edge of curved section 14 and side wall 16. An approximate area of two inches (not shown) from each bottom wall 20, where the longitudinal edge of the curved section does not include a corner bead, is designed for mating an abutting section of corner bead extending up along the vertical stud 31, covered by drywall which forms the doorway casing.

Figure 3:
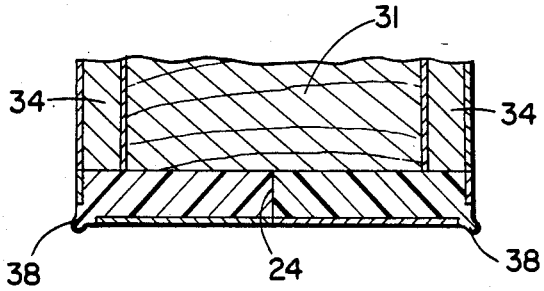
FIG. 3 is a cross-sectional view taken along sectional lines 3—3 shown in FIG. 1.

In FIG. 3, one of opposed vertical studs 31 which form doorway 4 is shown having both sides covered by drywall panels 34. The stud 31 measures $3\frac{1}{2}$ inches across with each section of drywall panel 34 being ½ inch wide, and thereby corresponding to the 4½ inch combined width of the archways 6 and 10. Therefore, with a minimum of time and effort, drywall compound is applied to the corner bead 38 area and tapered downward over the seam of the archways 6, 8, 10, 12 and the studs 31, 32 for a smooth finish of the archway. This is done in both the vertical and horizontal directions of the framed opening.

Figure 2:
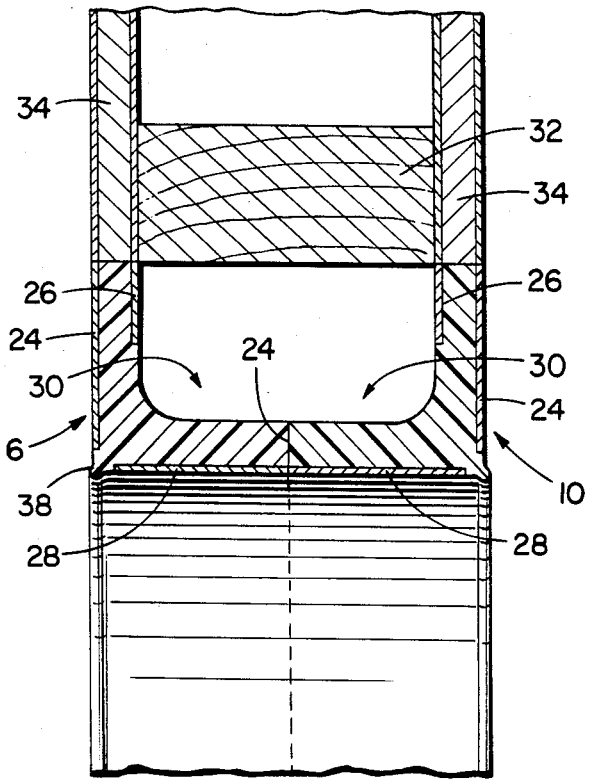
FIG. 2 is a cross-sectional view taken along sectional lines 2—2 shown in FIG. 1.
Figure 4:
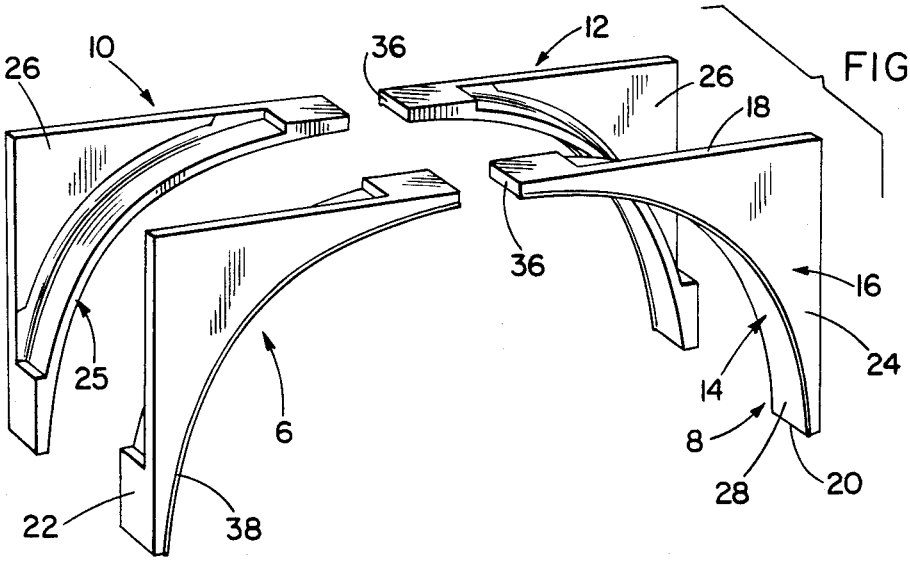
FIG. 4 is an exploded view of the four quarter archways which make up the full semicircular archway in FIG. 1.

In FIG. 2, header stud 32 is shown covered by drywall panels 34. Open areas 30 are shown for each archway 6 and 10 and corner bead 38 is shown integral with the body of each archway.

The archway sections shown in FIGS. 1 through 4 are installed by securing, by suitable adhesive, archways 6 and 10 and securing archways 8 and 12 along respective inner side walls 25 to form full quarter archways and by lifting the relatively light, rigid polyurethane foam full quarter archways 8, 12 and 6, 10 into the opening of a doorway 4 and nailing the full quarter archways in place along the curved section 14, near the wall 20, into studs 31 and through the curved section 14, near top wall 36, to header stud 32. The nailheads may be hit until recessed below the surface of the curved section 8 and covered over with drywall compound.

To assist in securing the full quarter archways in place, blocks of two by fours (not shown), approximately six inches in length are placed below, and nailed to the header stud 32, in a direction parallel with header stud 32. Nails are applied through the side walls 16 into the added pieces of two by four studding. This also helps in maintaining the exact spacial relationship between the side walls 16.

A full one-quarter archway 6, 10 may be used when the width of doorway 4 is greater than the width of a full semicircular archway 6, 10, and 8, 12. Opposed full one-quarter archways 6, 10 and 8, 12 are spaced from one another with a flat piece of one-half inch thick drywall interconnecting respective end walls 36 to form a continuous surface extending from the curved section 14 located on one half archway 6, 10, across the interconnecting drywall section, to an opposed curved section 14 of an opposed half archway 8, 12.

In FIG. 1, drywall tape is applied along the intersection of archway 6, 8, 10, 12 and drywall panels 34 to cover the seam between the full semicircular archway and the drywall panels. When drywall compound is applied to corner bead 38, the drywall compound is spread out to cover over the tape and the seam formed between the full semicircular archway and drywall secured to the beams 31, 32, forming the framed opening 4.

In an alternate embodiment of the present invention, two one-quarter archways, 6, 8 or 10, 12 are secured alon9 end wall 36 by a suitable adhesive. Side wall 25 is then located against a window positioned within a framed opening. This enables an archway to be formed right up against a glassed-in opening to allow additional light into a building while framing the window with an aesthetically pleasing archway.

Once a semicircular archway formed of two one-quarter arches 6, 8 or a full semicircular archway formed of four one-quarter archways 6, 8, 10, 12, is positioned within a framed opening, the seams between the edges of the archway sections and the drywall panels mounted on the wood framing are taped and drywall compound is spread across the exterior side walls 16 and curved sections 14 to produce a smooth finish.

The drywall paper sections 24, 26, 28, are secured in the molding process, respectively, to the exterior of side wall 24, the interior of side wall 24 and curved section 14. Drywall compound easily adheres to the drywall paper embedded in the quarter archway sections.

In the absence of such drywall paper sections, it would be difficult for the drywall compound to adhere to the polyurethane archway. The drywall paper used in the molds of the quarter archways may be identical to or similar to the drywall paper found on drywall panels 34 secured to vertical and horizontal studs 31 and 32. A continuous cohesive surface is thereby formed on the prefabricated archway of the present invention which is similar to a finish on a drywall panel and avoids the appearance of different types of construction material, when the prefabricated archway of the present invention is installed in a framed opening as shown in FIG. 1.

By the present invention, the prefabrication of an archway section reduces the time, materials and expense of installation of an archway. The increased savings over previous archways constructed at the job site are enormous and have greatly reduced the amount of man power required to complete an archway with increased quality due to uniform construction.

Having thus described the preferred embodiments of the invention, it should be understood that numerous structural modifications and adaptations may be resorted to without departing from the scope of the appended claims.

I claim:

1. A prefabricated archway attached to a framed opening, said prefabricated archway comprising:

a single body including a curved section being concavely curved and having a planar face, an exterior surface of a side wall being located adjacent to a longitudinal edge of said planar face, an outer periphery of said side wall being shaped complementary to said framed opening and spacing said planar face from said framed opening when said single body is attached within said framed opening, cohesive means secured to said planar face and to said exterior surface of said side wall for defining an adhesion surface on said planar face and said side wall, and a width of said planar face attached within said framed opening aligns exterior surfaces of said framed opening continuous with the exterior surface of said side wall and continuous with said planar face.

2. A prefabricated archway as in claim 1, wherein said single body further includes a corner bead extending from a longitudinal edge of said planar face.

3. A prefabricated archway as in claim 1, wherein two single bodies are secured to each other along an edge located opposite to said side wall and two pairs of said two single bodies form a semicircular archway.

4. A prefabricated archway as in claim 2, wherein said corner bead extends from said body a distance in a range of 1/16 to ⅛ of an inch.

5. A prefabricated archway as in claim 1, wherein two single bodies form a semicircular archway.

6. A prefabricated archway as in claim 1, wherein said unitary body is formed from expanded synthetic resinous material.

7. A prefabricated archway as in claim 1, wherein said single body is formed of rigid polyurethane foam.

8. A prefabricated archway attached within a framed opening, said prefabricated archway comprising:

a single body including a curved section having a planar face, an exterior surface of a side wall extending from an edge of said planar face, a corner bead defined between said planar face and said side wall, cohesive means secured to said planar face and said exterior surface of said side wall for defining an adhesion surface on said planar face and said side wall, an outer periphery of said side wall being shaped complementary to said framed opening to space said planar face from said framed opening when said single body is attached within said framed opening, and a width of said planar face when said single body is attached within said framed opening aligns exterior surfaces of said framed opening continuous with said exterior surface of said side wall and continuous with said planar face.

9. A prefabricated archway as in claim 8, wherein two single bodies form a semicircular archway.

10. A prefabricated archway as in claim 8, wherein two single bodies are secured at an edge located opposite to said side wall and two pairs of said two single bodies form a semicircular archway for a doorway.

11. A prefabricated archway as in claim 8, wherein said single body is formed from expanded synthetic resinous material.

12. A prefabricated archway as in claim 8, wherein said single body is formed of rigid polyurethane foam.

13. A prefabricated archway as in claim 8, wherein said cohesive means is drywall paper.

* * * * *